US007708070B2

(12) United States Patent
Roelofs

(10) Patent No.: US 7,708,070 B2
(45) Date of Patent: May 4, 2010

(54) SHAFT PLUGGING SYSTEM

(75) Inventor: Heinrich Jan Roelofs, Como (AU)

(73) Assignee: Tagfilm Pty Limited, Como (AU)

( * ) Notice: Subject to any disclaimer, the term of this patent is extended or adjusted under 35 U.S.C. 154(b) by 68 days.

(21) Appl. No.: 11/993,922

(22) PCT Filed: Jun. 29, 2005

(86) PCT No.: PCT/AU2005/000957

§ 371 (c)(1),
(2), (4) Date: Mar. 19, 2008

(87) PCT Pub. No.: WO2007/000009

PCT Pub. Date: Jan. 4, 2007

(65) Prior Publication Data

US 2008/0196885 A1 Aug. 21, 2008

(51) Int. Cl.
*E21B 33/00* (2006.01)

(52) U.S. Cl. ..... 166/285; 166/187; 299/12

(58) Field of Classification Search ..... 166/285, 166/187; 299/12
See application file for complete search history.

(56) References Cited

U.S. PATENT DOCUMENTS

| | | | | |
|---|---|---|---|---|
| 2,271,005 | A * | 1/1942 | Grebe | 175/61 |
| 4,013,097 | A | 3/1977 | Calandra | |
| 4,449,584 | A * | 5/1984 | Christensen | 166/187 |
| 4,458,245 | A * | 7/1984 | Crosnier et al. | 340/853.3 |
| 5,027,895 | A * | 7/1991 | Barton | 166/186 |
| 5,392,853 | A * | 2/1995 | Toon | 166/187 |
| 2004/0112451 | A1 * | 6/2004 | Lundman | 138/93 |

FOREIGN PATENT DOCUMENTS

| | | |
|---|---|---|
| AU | 17883/97 | 2/1998 |
| DE | 19952306 | 5/2000 |
| DE | 10258300 | 6/2004 |

* cited by examiner

*Primary Examiner*—William P Neuder
(74) *Attorney, Agent, or Firm*—Gottlieb, Rackman & Reisman

(57) ABSTRACT

A shaft plug for a mine shaft, the shaft plug comprising an inflatable bladder adapted to be inflated by pressurised gas, the bladder being adapted to be positioned within a shaft prior to inflation and to be inflated to contact the walls of the shaft to thereby seal the shaft and provide support to the shaft wall. A plurality of shaft plugs are adapted to by linked together in a manner to provide gas communication between the shaft plugs to provide a shaft plug to enable the shaft to be substantially filled by the shaft plug when inflated. Also defined is a method of sealing a mine shaft and supporting the shaft wall by use of a shaft plug.

14 Claims, 6 Drawing Sheets

SHAFT PLUGGING SYSTEM

FIELD OF THE INVENTION

The present invention relates to a means of sealing shafts in mines. It also may be used for creating shafts in a manner that is described within this specification.

Throughout the specification the term "shaft" shall be taken as including any form of underground passage, either natural or man-made, which has a significant vertical component. The invention is particularly directed for use with shafts which are vertical or near vertical, but can be adapted for use with obliquely oriented shafts, including ore passes, waste passes, disused vertical dams, tipples and finger raises and other passages.

Throughout the specification including the claims, unless the context requires otherwise, the word "comprise" or variations such as "comprises" or "comprising", will be understood to imply the inclusion of a stated integer or group of integers but not the exclusion of any other integer or group of integers.

BACKGROUND

Shafts are provided in underground mines for a variety of reasons including access between levels and ventilation. When they are no longer required for the purpose for which they were provided, their presence becomes problematic. The shaft becomes a safety hazard for people who must work or move under or in the vicinity of the shaft at the lower level because debris is commonly dislodged from the shaft wall and it is possible for objects to fall from the upper level. In many instances it is deemed necessary to seal such shafts by filling them completely with concrete. But it will be readily appreciated that this is a very expensive solution to overcome the safety risk. In other circumstances, closure of the shaft is only required temporarily, and if it has been sealed for safety reasons, the subsequent removal of the sealing material is also an expensive task.

Throughout the specification and claims the term "shaft" shall be taken as a passageway which is provided in a mine or a like environment and which has an inclination generally in excess of 45° and which interconnect two passageways in the forms of tunnels where the tunnels serve to provide access for the passage of personnel along the tunnels.

Shafts are used in mines for the purposes of ventilation and the delivery of materials from the upper tunnel into the lower tunnel. When the shafts are no longer required either permanently or for a period of time, it is desirable that the shaft be closed in order that the danger that the open shaft can present for personnel in the tunnels connected by the shaft is reduced. In this regard it is desirable that the blocking of the shaft be readily reversible and that the shaft be blocked close to the junctions of the shaft with each tunnel that it connects to. Where the shaft connects with a tunnel at or proximate the floor of a tunnel, the blockage of the shaft close to the tunnel ensures that anyone or anything that falls into the shaft will not fall very far and can be readily retrieved from the shaft. In addition, where the shaft connects with a tunnel at or close to the roof of a tunnel, the blockage of the shaft close to the roof minimises the amount of rock material from the walls of the shaft that can fall into the shaft.

DISCLOSURE OF THE INVENTION

Accordingly, the invention resides in a shaft plug which is use is to be used to close a shaft of the form as described, whereby the shaft plug comprises a plurality of inflatable bladders, each bladder having an upper end and a lower end, the bladders being interconnected in an end to end relationship, the shaft plug further comprising a support which extends along the length of the shaft plug and around the shaft plug, said support comprising a set of cord elements located at angularly spaced intervals around the shaft plug, with each cord element extending for the length of the shaft plug, and each cord element fixed to the walls of the bladders at a plurality of positions spaced along the length of each bladder, the upper end of the cord elements being interconnected to enable the shaft plug to be supported from the upper end when the bladders are not fully inflated, with each bladder having an inlet, and a gas line connected to each inlet and intended in use to be connected to a source of pressurised gas to enable the bladders to be inflated. Each bladder, in use, is able to be inflated when in position in the shaft such that the inflated bladder will extend across the shaft to contact the walls of the shaft to be supported, thereby and to consequently seal the shaft, said bladders being interconnected such that in use the uppermost bladder is positioned in the vicinity of the upper end of the shaft and the lowermost bladder is positioned in the vicinity of the lower end of the shaft, wherein each bladder when inflated provides support to portion of the wall of the shaft in contact with the bladder.

According to a preferred feature of the invention, the interior of the bladders are in fluid communication with each other and an end most bladder is arranged and configured to be connected to a source of pressurised gas.

According to a preferred feature of the invention, each bladder is provided with an aperture in the upper end and the lower end and the opposed apertures of adjacent bladders are interconnected. According to a preferred feature of the invention, the apertures are defined by a flanged opening, whereby in use the flanged openings of adjacent bladders are located in abutting relationship with each other and are held in sealing engagement with each other by a clamping ring. According to a preferred feature of the invention, the end most bladder is arranged and configured to be connected to a source of pressurised gas.

According to a preferred feature of the invention, adjacent bladders are located in close proximity with each other such that in use the walls of the inflated bladders jointly contact most of the wall of the shaft between the ends of the shaft. According to a preferred feature of the invention, the shaft plug is re-usable.

According to a preferred embodiment, the bladder is manufactured from fibre-reinforced polyvinylchloride.

According to a preferred embodiment, the bladder is manufactured from a woven polyester 8×8.5 incorporating tear stop threads in both directions, PVC coated with acrylic lacquer on the top surface or a similar material.

According to a preferred embodiment, the bladder is manufactured from a woven polyester 8×8.5 incorporating tear stop threads in both directions, polyvinylchloride coated with acrylic lacquer on one surface or a similar material.

According to a further aspect, the invention resides in a shaft sealing method comprising the insertion of an inflatable shaft plug of the form as described above into a shaft such that the uppermost bladder is proximate the upper end of the shaft and the lowermost bladder is proximate the lower end of the shaft, and inflating the bladders.

According to preferred feature of the invention the plug is installed into the shaft by introducing one end of the shaft plug into the lower end of the shaft and lifting the one end through the shaft until the uppermost bladder is located proximate the upper end of the shaft before inflating the bladders.

According to an alternative preferred feature of the invention the shaft plug is are installed into the shaft by introducing one end of the shaft plug into the upper end of the shaft and lowering the one end through the shaft until the lowermost bladder is located proximate the lower end of the shaft before inflating the bladders. The invention will be more fully understood in the light of the following description of one specific embodiment.

BRIEF DESCRIPTION OF THE DRAWINGS

The description is made with reference to the accompanying drawings of which.

DETAILED DESCRIPTION OF SPECIFIC EMBODIMENT

Figure 1:
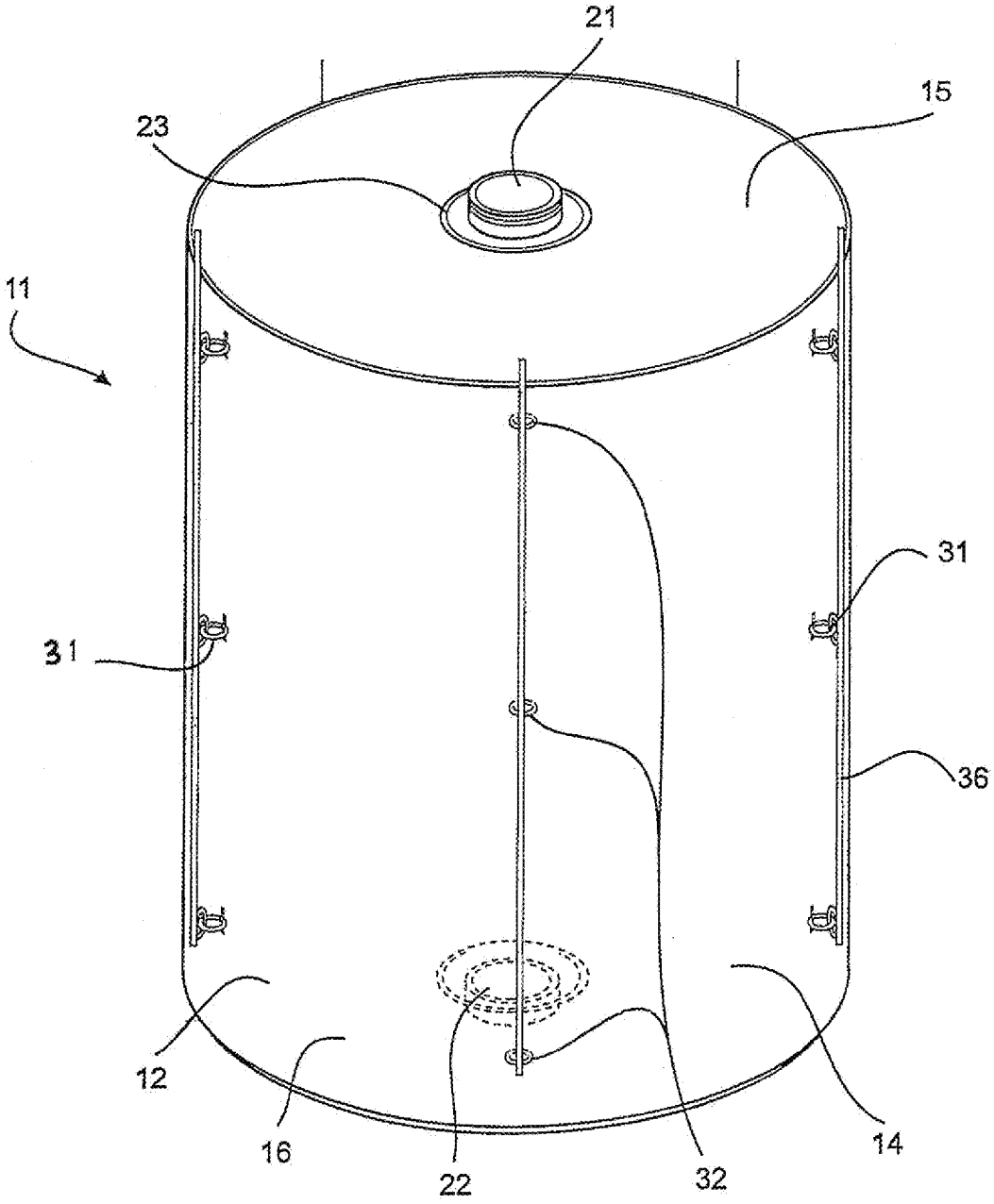
FIG. 1 is an isometric view of a bladder shown in an inflated condition which is to be used in a shaft plug according to the first embodiment.

The embodiment of the invention is directed to an inflatable shaft plug adapted to be installed in a mineshaft. The embodiment is described with reference to FIGS. 1 to 5.

The embodiment is a shaft plug which is formed from a plurality of inflatable bladders 11 where each bladder comprises a wall 12 of flexible, substantially airtight material which is adapted to be installed into a substantially vertical shaft. Reinforced PVC sheeting has been found to be particularly suitable for this application although other materials will also fulfil the function. One material found particularly suitable comprises a Panama woven polyester, 12×12 PVC coated with Acrylic lacquer on both sides. This product is marketed under the trade mark "COMPLAS 300" Fabric. An alternative material is a woven polyester 8×8.5 incorporating tear stop threads in both directions, PVC coated with acrylic lacquer on the top surface. This product is marketed under the trade mark "TARPOL". The material can be selected more particularly for the application according to its properties, particularly to provide suitable strength and weight characteristics.

The bladder 11, when inflated as described below, expands to fill a portion of the shaft 10.

The majority of shafts in mines have a generally circular cross-section, due to the manner of construction and therefore, and as shown in the drawings, the bladder 11 of the first embodiment takes a generally cylindrical appearance when inflated, having a circumferential wall 14 and being closed at the ends of the cylindrical form by an upper end panel 15 and lower end panel 16. The bladder 11 of the first embodiment has a length which is of similar dimension when not inflated to the diameter of the bladder when inflated. This has been found to be a reasonable optimum between effectiveness and efficiency. Due to the flexibility of wall material used, the bladder 11 is capable of conforming generally to the profile of the walls of a shaft (which need not be of circular cross-section), including the accommodation of irregularities caused by the prior dislodgement of material from the face of the shaft wall. It will of course be appreciated that where a shaft has a cross-section substantially departing from the circular form such as rectangular or square, it is preferable that the bladder has a generally complementary cross-section.

While it would be possible to construct a shaft plug comprising a single bladder 11 that extends the full length of the shaft, such a shaft plug would be difficult to manufacture and cumbersome to transport and install.

Figure 2:
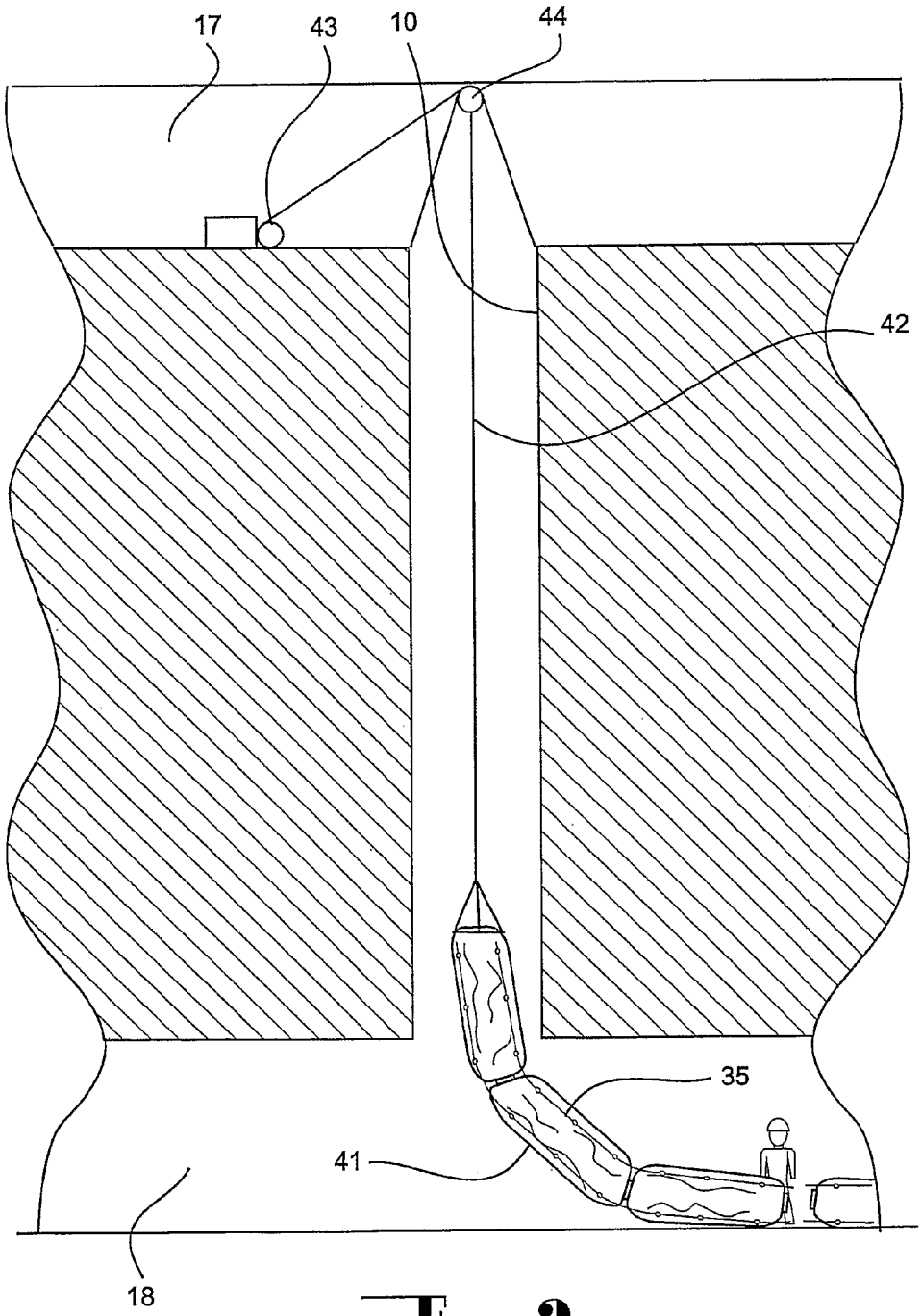
FIG. 2 is a schematic side elevation of a shaft plug comprising a plurality of bladders of the type shown in FIG. 1, the shaft plug being shown prior to insertion into a shaft.
Figure 3:
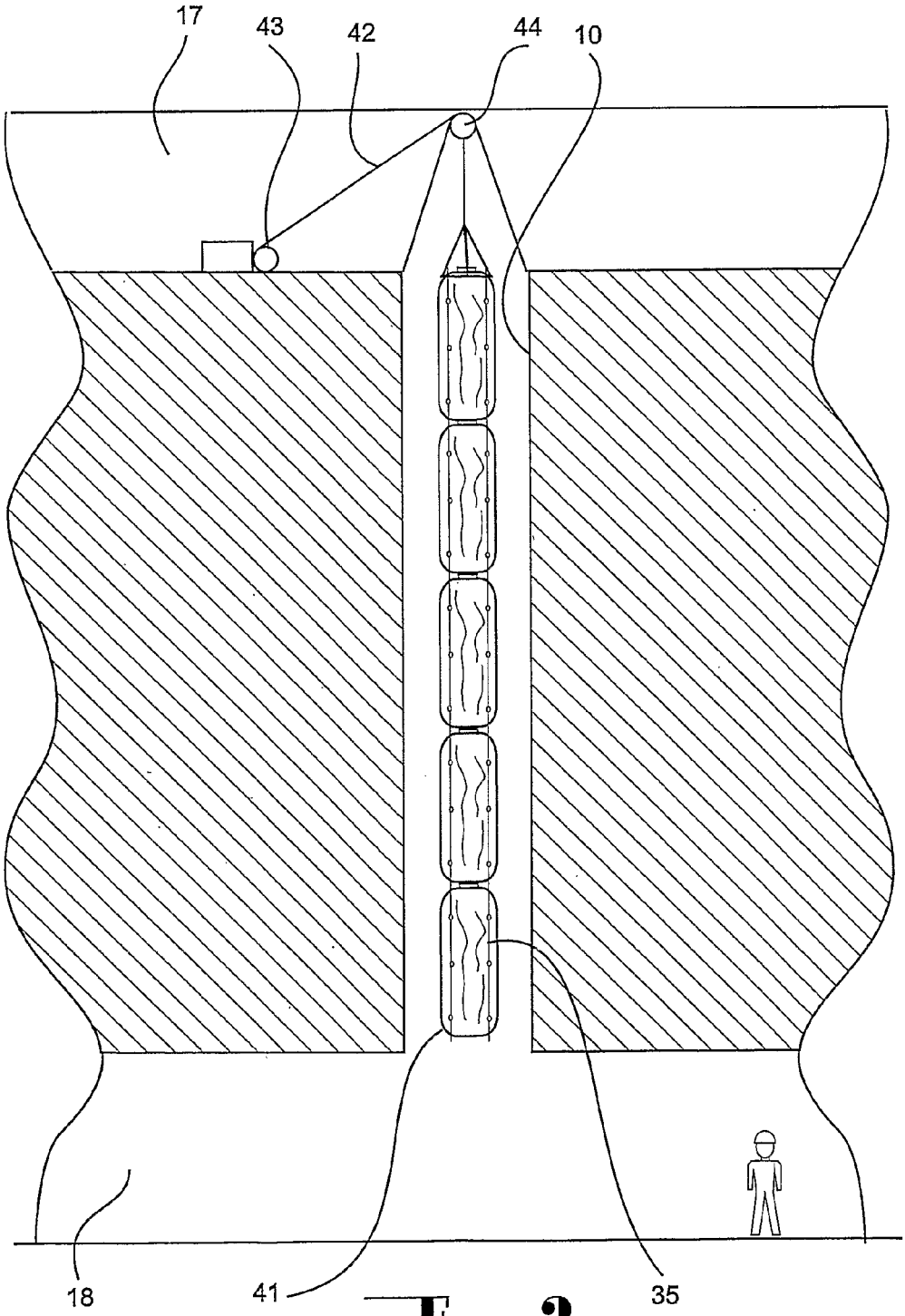
FIG. 3 is a schematic side elevation of the shaft plug shown in FIG. 2, the shaft plug being shown in position in the shaft prior to inflation.
Figure 4:
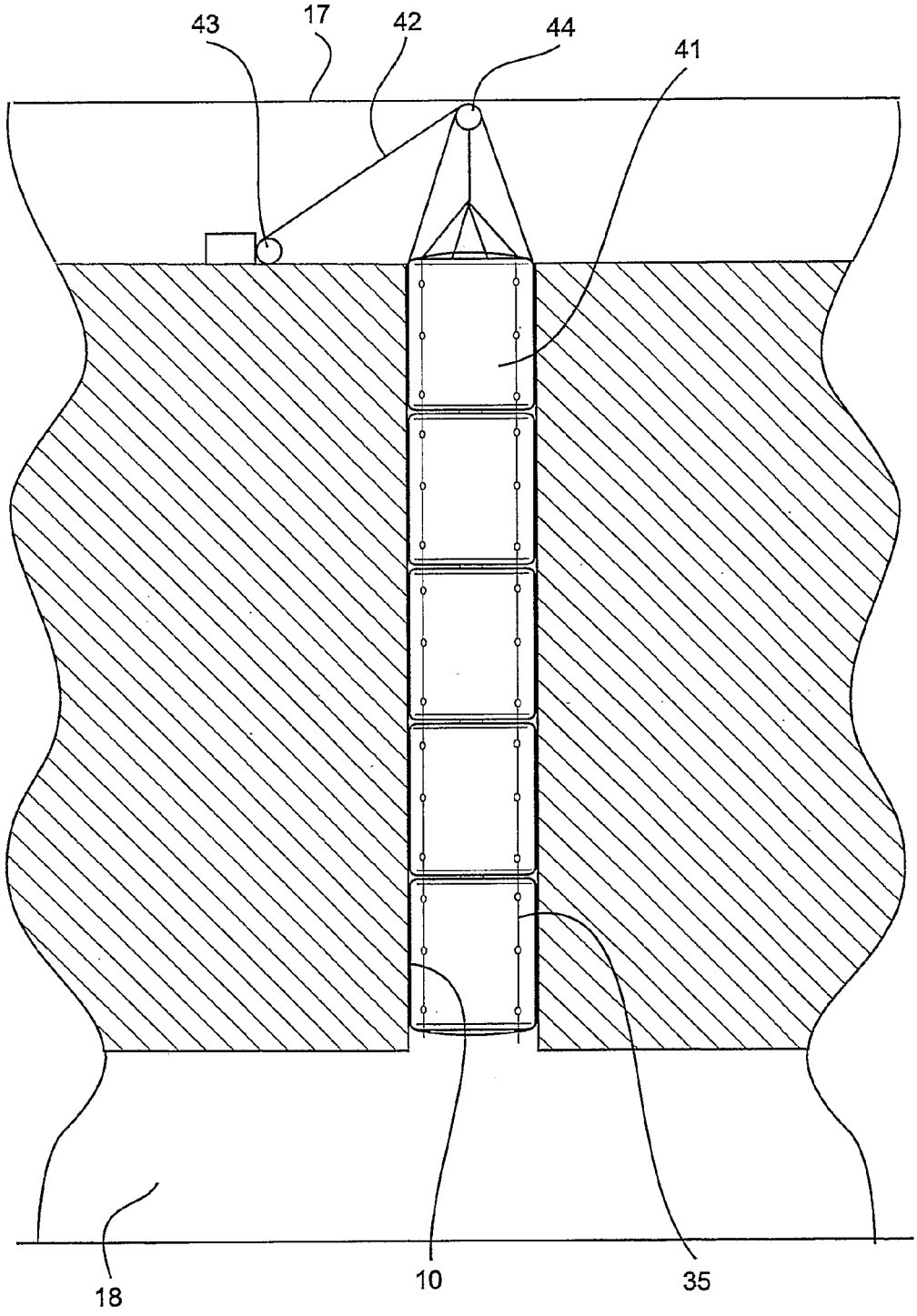
FIG. 4 is a schematic side elevation of the shaft plug shown in FIG. 3, the shaft plug being shown in position in the shaft and in inflated condition.

Typically, mine shafts in which the embodiment would be used are substantially longer than the diameter of the shaft. For instance shafts are often between 2.4 meters and 5 meters in diameter but have a length of 20 meters or more, sometimes in excess of 150 meters. In order to function effectively, particularly in preventing wall material from dislodging from the shaft, it is necessary that substantially the full length of the shaft be filled. If a bladder is located at the top of a shaft and only extends only partially down the length of the shaft, material defining the wall of below the bladder can become dislodged and fall to the tunnel below. If the bladder is located in the a lower portion of a shaft, wall material dislodged from the wall of the shaft above the plug may acquire sufficient momentum before impacting the bladder so that it would puncture the plug and possibly cause both the plug and material to fall to the tunnel. In addition, the open upper end of a shaft which has been closed at the lower end presents a hazard for persons in the upper tunnel or tunnels into which the shaft opens. The shaft plug 41 according to the embodiment comprises a plurality of bladders 11 interconnected in an end to end relationship and which are supported such that the bladders can be sequentially installed within the shaft, in a manner described below. As shown in FIGS. 2, 3 and 4, a shaft plug 41 which comprises a plurality of bladders 11 may be used, adapted to substantially fully occupy the void of the shaft.

Figure 6:
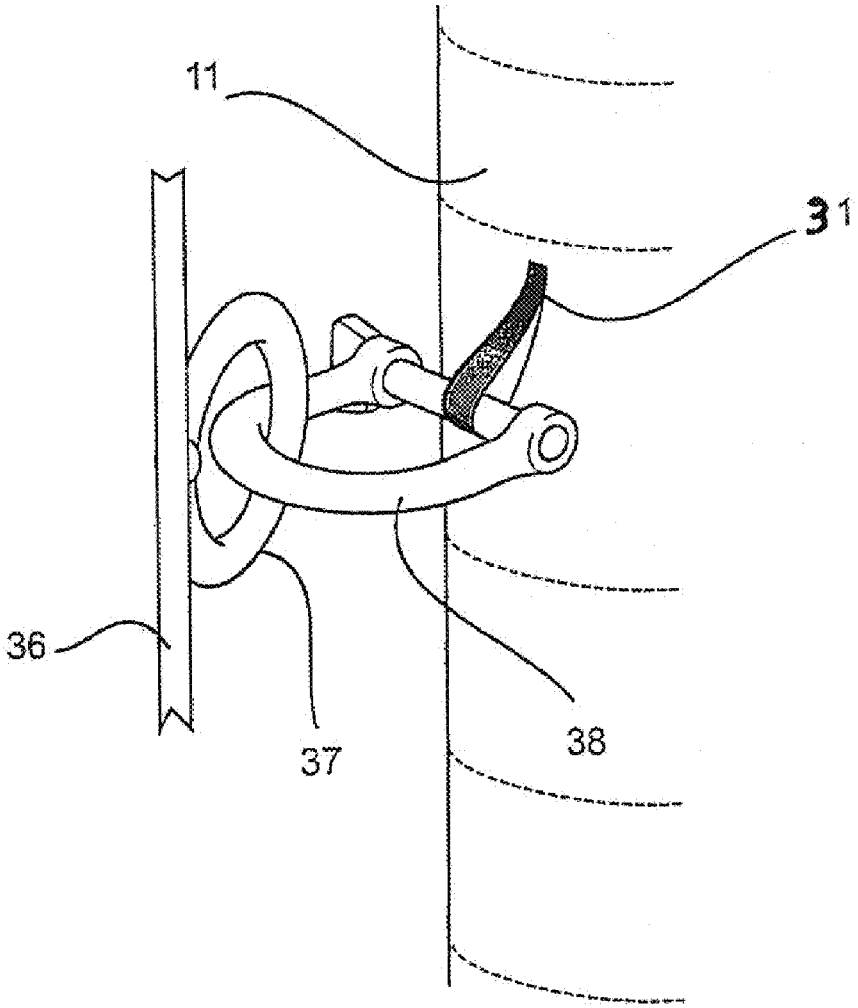
FIG. 6 is a partial sectional view showing the manner in which a support harness is fixed to one of the bladders of the shaft plug according to the first embodiment of the invention.

In order to support and position the shaft plug 41 when the bladders are not fully inflated (such as during installation or removal), the shaft plug 41 further comprises a support. In the embodiment, the support comprises a set anchor points 31 secured to the side wall 14 of the bladder. The anchor points 31 are typically loops of the fabric material used for the wall of the bladder and which are secured to the wall by adhesive, stitching, welding or a combination of these methods. The anchor points 31 comprise several sets where each set of anchor points 31 comprises a number of anchor points positioned at axially spaced intervals along the side wall 14 of the bladder and where the sets are disposed at equi-angular spacings around the side wall of the bladder 11. In forming the shaft plug, the sets of anchor points of the bladders are axially aligned (as shown in FIGS. 2, 3 and 4). In addition, the support includes a support harness 35 which comprises a set of lengths of webbing 36 of a form similar to that utilised for seat belts of motor vehicles. The lengths of webbing 36 are in one to one correspondence with the sets of anchor points of the shaft plug. Each length of webbing 36 is associated with loops 37 (see FIG. 6) at spaced intervals along its length. The spacing of the loops corresponds with the spacing of the anchor points of the respective set of anchor points and in use each loop is engaged with a corresponding anchor point in a set of anchor points. Engagement between each anchor point 31 and loop 37 is effected by a shackle 38 or comparable engagement means. The lengths of webbing 36 extend beyond the upper end of the bladder and are provided with an end loop and the upper ends are interconnected by a suitable fixing which provides an upper support from which the shaft plug 41 can be supported.

Figure 5:
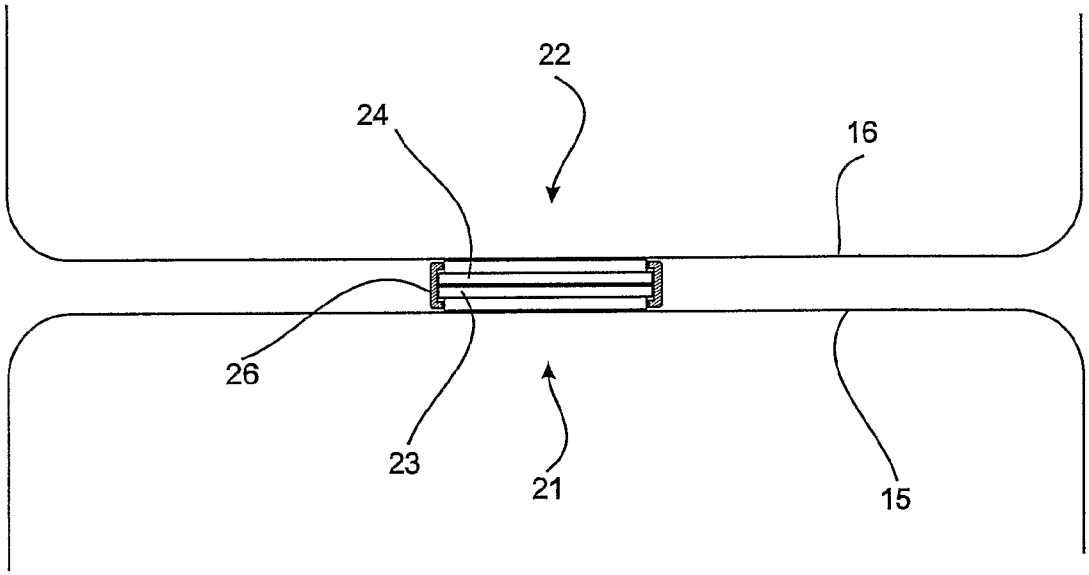
FIG. 5 is a schematic partial sectional side elevation of the abutting ends of a pair of bladders of the form shown in FIG. 1 identifying the interconnection of the inflation flanges.

The upper end panel 15 and the lower end panel 16 of each bladder 11 are each provided with a centrally located aperture 21 and 22 respectively. A connector is associated with the apertures to enable connection of adjoining bladders. The connector comprises a flange 23 and 24 surrounding the respective apertures 21 and 22 and a clamping ring 26. Suitable flanges are commercially available in the market place. The flanges are sealingly interconnected by means of the clamping ring 26. As shown in FIG. 5, by means of the inflation flanges, the upper end panel 15 of a lower bladder may be engaged with the lower end panel 16 of an upper bladder during installation, in a manner whereby communication of the inflation gas between the panels is enabled through the centrally located apertures 21 and 22 of each, but that the adjoining panels are held together in the vicinity of the inflation flanges. In the case of the upper or lowermost bladder, the aperture in the upper end panel or the lower end panel respectively is connected by an air line to a source of pressurised air to effect the inflation of the bladders of the shaft plug. In addition, the aperture in the lower end panel or the upper end panel respectively is closed by suitable closure (not shown). Alternatively, according to a variation of the embodiment, the lower end or the upper end panel is not provided with an aperture In this way, a series of bladders 11 are longitudinally interconnected to enable the joint inflation of the bladders of the shaft plug.

In use, the shaft plug is intended to be installed by being raised from the lower tunnel rather than being lowered from the upper tunnel, as shown at FIGS. 2, 3 and 4, although the latter may be achieved with additional installation safety steps. In installing the shaft plug 41, the upper support which is provided by the interconnected upper ends of the lengths of webbing 36 are connected to a support cable 42 which extends from a winch 43 in the upper tunnel 17 over a pulley 44 positioned centrally above the shaft 10 and down through the shaft into the lower tunnel 18. The pulley 44 may be suspended from the roof of the upper tunnel 17 or alternatively mounted on a support frame positioned over the upper end of the shaft 10.

In a preferred method of installation, the support harness 35 is assembled near the shaft 10 in the lower tunnel 18 and the upper support is attached to the support cable 42. The first (uppermost) bladder is then attached to the support harness in deflated condition and then drawn partially into the shaft 10. The second bladder is then attached to the support harness and the flanges of the abutting end panels are clampingly engaged by the clamping ring 26. The support cable is again raised until the second bladder partially enters the shaft. The process is then repeated until all bladders in the shaft plug 41 are installed in the support harness 35. The shaft plug is then raised so that the upper end of the uppermost bladder is substantially level with the floor of the upper level, as shown in FIG. 3. The shaft plug is then inflated by a convenient gas source, normally air. Once the shaft plug is fully inflated, the circumferential walls of all of the bladders in the shaft plug will contact the shaft wall. Although the gas pressure is quite low (typically in the order of 4 kPa (0.5 psi), the shaft plug is held firmly in position by friction because of the large area of contact. Due to this area of contact and the strength of the material used, it has been found that the bladder when inflated, provides significant support to the shaft wall, even at the low pressure mentioned. Loose wall debris' or other material is held firmly and securely in place, thereby providing a safe environment below the sealed shaft. Once the shaft plug is in position, workers may move and work under the sealed shaft secure against falling material.

Those skilled in the art will readily appreciate that, when the shaft plug is inflated, the end panels of the uppermost and lowermost plugs will bow outwardly relative to the planar surface transverse to the cylindrical axis of the bladder. At the upper end, within reason, this is not a problem as it is not permissible to work above the shaft and the bowing out therefore does not interfere with any activities. However, at the lower end, excessive bowing out may interfere with mine operation. Therefore, on installation of the shaft plug, the lowermost bladder is installed so that persons can move and work below the shaft without interference. According to a variation of the embodiment, the lower end panel of the lowermost bladder is configured so that the lower end panel is tensioned sufficiently when the circumferential wall 14 is pressed against the shaft wall when the shaft plug is inflated. In practice, it has been found that bowing of approximately 0.5 meters is achieved and this is considered quite acceptable.

It is to be noted that, in joining successive bladders together in the manner shown in FIG. 5, a good airtight fit between the two panels is desirable but not essential. In the event of some limited leakage on inflation of the shaft plug abutting end panels will tend to be pressed together and react as a single element. If gas escapes between adjoining panels, the pressure it is at substantially held within the confined region of the sealed shaft. Some leakage may occur into the ore, but this will generally be low. For safety, it is considered necessary to maintain a supply of air to the shaft plug continuously to replenish any lost air but the air volume required will generally be very small if the integrity of the sealing is high. It may be noted that a sudden, substantial increase in air usage would indicate a fault which may require maintenance.

It should be appreciated that the scope of the present invention need not be limited to the particular scope of the embodiments described above. For instance, it would be quite possible to inflate the shaft plug by insertion of the pressurised gas into the inflation aperture in the lower panel of the lowermost bladder. A further adaptation would be to provide the harness as a single unit adapted to accommodate all of the bladders in the plug shaft plug. Another adaptation would be to inflate each bladder in a plug independently of the other bladders in the shaft plug. In such a case, the inflation aperture might be located within the side wall of the bladder rather than the end wall.

An alternative method of installation of the bladders of a shaft plug is to install and inflate a first bladder at the lower end of the shaft and then to lower a subsequent bladder upon the previously inflated bladder from above. Successive bladders would be added to fill the shaft. It is to be recognized that all such adaptations including others not mentioned are intended to be included within the scope of the invention.

The invention claimed is:

1. A shaft plug which is use is to be used to close a shaft, the shaft plug comprising a plurality of inflatable bladders, each bladder having an upper end and a lower end, the bladders being interconnected in an end to end relationship, the shaft plug further comprising a support which extends along the length of the shaft plug and around the shaft plug, said support comprising a set of cord elements located at angularly spaced intervals around the shaft plug, each cord element extending for the length of the shaft plug, each cord element fixed to the walls of the bladders at a plurality of positions spaced along the length of each bladder, the upper end of the cord elements being interconnected to enable the shaft plug to be supported from the upper end when the bladders are not fully inflated, each bladder having an inlet, a gas line connected to each inlet and intended in use to be connected to a source of pressurised gas to enable the bladders to be inflated, wherein in use each bladder is able to be inflated when in position in the shaft such that the inflated bladder will extend across the shaft to contact the walls of the shaft to be supported thereby and to consequently seal the shaft, said bladders being interconnected such that in use the uppermost bladder is positioned in the vicinity of the upper end of the shaft and the lowermost bladder is positioned in the vicinity of the lower end of the shaft, wherein each bladder when inflated provides support to a portion of the wall of the shaft in contact with the bladder.

2. A shaft plug as claimed in claim 1 wherein the connection between the bladders includes a fluid connection between the interiors of the bladders.

3. A shaft plug as claimed in claim 2 wherein each bladder is provided with an aperture in the upper end and the lower end and the opposed apertures of adjacent bladders are interconnected.

4. A shaft plug as claimed in claim 3 wherein the apertures are defined by a flanged opening wherein in use the flanged openings of adjacent bladders are located in abutting relationship with each other and are held in sealing engagement with each other by a clamping ring.

5. A shaft plug as claimed at claim 4 wherein adjacent bladders are located in close proximity with each other such that in use the walls of the inflated bladders jointly contact most of the wall of the shaft between the ends of the shaft.

6. A shaft plug as claimed in claim 4 wherein an end most bladder is arranged and configured to be connected to a source of pressurised gas.

7. A shaft plug as claimed at claim 1 wherein the shaft plug is re-usable.

8. A shaft plug as claimed in claim 1 wherein each bladder is manufactured from fibre-reinforced polyvinylchloride.

9. A shaft plug as claimed at claim 1 wherein each bladder is manufactured from a woven polyester, 12×12 polyvinylchloride coated with acrylic lacquer on both sides or a similar material.

10. A shaft plug as claimed at claim 1 wherein each bladder is manufactured from a woven polyester 8×8.5 incorporating tear stop threads in both directions, polyvinylchloride coated with acrylic lacquer on one surface or a similar material.

11. A shaft sealing method comprising the insertion of an inflatable shaft plug of the form as claimed in claim 1 into a shaft such that the uppermost bladder is proximate the upper end of the shaft and the lowermost bladder is proximate the lower end of the shaft, and inflating the bladders.

12. A shaft sealing method as claimed in claim 11 wherein the plug is installed into the shaft by introducing one end of the shaft plug into the lower end of the shaft and lifting the one end through the shaft until the uppermost bladder is located proximate the upper end of the shaft before inflating the bladders.

13. A shaft sealing method as claimed in claim 11 wherein the shaft plug is installed into the shaft by introducing one end of the shaft plug into the upper end of the shaft and lowering the one end through the shaft until the lowermost bladder is located proximate the lower end of the shaft before inflating the bladders.

14. A shaft plug as claimed in claim 1 wherein the interior of the bladders are in fluid communication with each other and an end most bladder is arranged and configured to be connected to a source of pressurised gas.

* * * * *